US011641983B2

(12) United States Patent
Gould et al.

(10) Patent No.: US 11,641,983 B2
(45) Date of Patent: May 9, 2023

(54) SOAP TRAVEL CASE

(71) Applicant: SoapStandle, LLC, Memphis, TN (US)

(72) Inventors: James Gould, Memphis, TN (US); Sam Shifron, Del Mar, CA (US)

( * ) Notice: Subject to any disclaimer, the term of this patent is extended or adjusted under 35 U.S.C. 154(b) by 89 days.

(21) Appl. No.: 16/591,571

(22) Filed: Oct. 2, 2019

(65) Prior Publication Data

US 2020/0100625 A1 Apr. 2, 2020

Related U.S. Application Data

(60) Provisional application No. 62/740,015, filed on Oct. 2, 2018.

(51) Int. Cl.

| | |
|---|---|
| ***A47K 5/03*** | (2006.01) |
| ***A47K 5/00*** | (2006.01) |
| ***B65D 55/02*** | (2006.01) |
| ***B65D 85/00*** | (2006.01) |
| ***B65D 43/14*** | (2006.01) |
| ***B65D 43/00*** | (2006.01) |
| ***B65D 55/10*** | (2006.01) |

(52) U.S. Cl.

CPC ..... *A47K 5/03* (2013.01); *A47K 5/00* (2013.01); *B65D 43/00* (2013.01); *B65D 43/14* (2013.01); *B65D 55/02* (2013.01); *B65D 55/10* (2013.01); *B65D 85/00* (2013.01); *B65D 2255/00* (2013.01)

(58) Field of Classification Search

CPC ... A47K 5/08; A47K 5/02; A47K 5/04; A47K 5/05; A47K 5/03; B65D 85/62; B65D 43/14; B65D 85/00; B65D 55/10; B65D 88/02; B65D 2255/00; B65D 43/00

USPC ..... 425/84; 252/92; 206/77.1; 211/85.12, 211/70, 78, 163; 220/331

See application file for complete search history.

(56) References Cited

U.S. PATENT DOCUMENTS

| | | | | | |
|---|---|---|---|---|---|
| 1,290,238 | A * | 1/1919 | Klenetzky | B43K 23/016 | 401/88 |
| 1,340,327 | A * | 5/1920 | Conner | A47K 5/02 | 312/351 |
| 1,358,540 | A * | 11/1920 | Goodwin | A47K 5/02 | 206/77.1 |
| 1,689,787 | A * | 10/1928 | Kupferschmid | A47K 5/05 | 401/88 |
| 2,283,988 | A * | 5/1942 | Heath | A47K 5/05 | 401/6 |
| 2,356,056 | A * | 8/1944 | Hogg | A47K 5/03 | 206/77.1 |
| 2,851,713 | A * | 9/1958 | Tupper | A47K 7/02 | 15/105 |

(Continued)

*Primary Examiner* — Chun Hoi Cheung

(57) ABSTRACT

A travel case for a bar of soap is provided. In various embodiments, the travel case permits accelerated drying of the bar of soap and prolongs the life of the soap. The travel case is designed to maintain the bar of soap in a fixed horizontal and vertical position during transport. The travel case includes a lid and a base with a walled receiving portion. The receiving portion is configured to receive a bar of soap that is attached to a soap support and hold the soap support such that the bar of soap is prevented from contacting the surface of the soap case. A method of reversibly securing a bar of soap within a soap case while maintaining the soap in a fixed horizontal and vertical position is also provided herein.

14 Claims, 16 Drawing Sheets

(56) References Cited

U.S. PATENT DOCUMENTS 3,019,548 A * 2/1962 Nadler ..... A47K 5/05 401/88
3,681,806 A * 8/1972 Han ..... A47K 5/03 15/105
3,688,895 A * 9/1972 Henry ..... A45D 40/221 206/37
3,899,073 A * 8/1975 Barr ..... A47K 5/03 206/77.1
4,207,975 A * 6/1980 Arzillo ..... A47K 5/05 206/77.1
4,344,529 A * 8/1982 Ibarzabal ..... A47K 5/02 206/77.1
4,458,826 A * 7/1984 Mu-Jung ..... B65D 43/14 220/811
4,501,354 A * 2/1985 Hoffman ..... A47K 5/00 206/499
4,611,716 A * 9/1986 Sorlien ..... A45D 27/22 132/316
4,754,874 A * 7/1988 Haney ..... A47K 5/02 132/286
4,934,640 A * 6/1990 Bichon ..... A47K 5/02 206/77.1
4,969,587 A * 11/1990 Miller ..... A45D 34/00 132/315
5,029,802 A * 7/1991 Ali ..... A47K 5/05 248/309.2
5,279,412 A * 1/1994 Lee ..... A47K 5/03 206/77.1
5,390,971 A * 2/1995 Warren ..... A47K 5/05 294/165
5,417,397 A * 5/1995 Harnett ..... A47K 5/05 248/309.4
5,941,376 A * 8/1999 Liggett ..... A47K 5/02 206/77.1
6,152,294 A * 11/2000 Weinberg ..... A47K 5/03 206/77.1
7,677,386 B1 * 3/2010 Kumar ..... A47K 5/03 206/77.1
7,721,908 B2 * 5/2010 Cronin ..... B65D 43/12 220/345.4
9,763,547 B2 * 9/2017 Smith, III ..... A61K 8/0204
2003/0178326 A1 * 9/2003 Belyakov ..... A47K 5/05 206/77.1
2009/0145914 A1 * 6/2009 Seehoff ..... B65D 25/2811 220/676
2009/0173644 A1 * 7/2009 Srungaram ..... A47K 5/03 206/77.1
2015/0034502 A1 * 2/2015 Dickinson ..... B65D 81/36 206/77.1
2015/0282677 A1 * 10/2015 Gould ..... A47K 5/05 248/176.1
2018/0049600 A1 * 2/2018 Smith ..... A47K 5/05

* cited by examiner

SOAP TRAVEL CASE

CROSS REFERENCE TO RELATED APPLICATIONS

This application claims priority to U.S. Provisional Application No. 62/740,015, filed Oct. 2, 2018.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

Field of the Invention

The present invention relates to devices used to keep a bar of soap dry during transport or travel.

Technology in the Field of the Invention

It is known virtually worldwide to use a bar of soap for washing. Millions of people use soap every day for the washing of hands and body. The traditional bar of soap comprises a dry material that becomes a surface acting agent (or "surfactant") when applied to human skin with water. The soap is generally made by treating vegetable or animal oils and fats with a strongly alkaline solution.

While traveling or using shared bathing areas such as a communal shower, it is commonplace to place the bar of soap in a travel case or other enclosure after use. Such a travel case allows for storage of the soap and prevents soap residue from being transferred to items or products stored in close proximity thereto. However, this creates a problem as a pool of water tends to collect under the bar of soap after use. Moreover, the bar tends to retain and even absorb at least a small amount of water while it sits in the pool, causing the soap to become gooey. This "goo" becomes a source of soap loss. Over the life of a bar of soap, it is estimated 15 to 20% of soap volume may disintegrate, slough off the bar, or adhere to the travel case due to this condition. As a result, the life of the bar of soap is substantially shortened.

To diminish this problem, some have created soap travel cases having ridges along a bottom surface. The soap is placed on top of the ridges in the case, allowing the soap to rest above shallow pool of water that may form between uses. However, the ridges tend to create only very shallow trenches, meaning that in some cases the bar of soap is still in contact with water. In addition, moisture residing on or in the bar can become trapped along the soap case ridges. Further, traditional soap travel cases do not fix the soap in a given position, and the soap slides against the various surfaces of the case. Soap travel cases may become inverted during travel or transport to/from the bathing area causing the unfixed soap to rest on a non-ridged surface, thereby exposing the soap to the water or moisture within the case.

To avoid these issues, many manufacturers have begun providing soap in liquid form, wherein the soap is dispensed from a container using a pump. In the U.S. and Europe, liquid soap has become a significant portion of soap sales.

However, for several reasons liquid soap has a higher environmental impact than bar soap, not the least of which is that liquid soap requires several times more energy for raw material production and 20 times more energy for packaging production than bar soap. Further, liquid soap tends to be more expensive than bar soap. Additionally, liquid soap is heavier and more voluminous than bar soap on a per-wash basis, making travel with the liquid soap more cumbersome. Also, as a result of bulky liquid soap containers, shipping liquid soap requires more space and more fuel to transport the same number of cleanings. It is also observed that empty liquid soap containers add several million pounds of plastic trash each year.

To address the troublesome development of soap "goo" on a bar of soap, U.S. Pat. No. 9,307,870 (the '870 Patent) and U.S. application Ser. No. 29/580,678, both of which are incorporated herein in their entireties by reference, disclose a soap support that attaches to an off-the shelf bar of soap. The soap support claimed in the '870 patent prevents the bar of soap from resting in a pool of water after use thereof, allowing the soap to dry quickly and remain dry between uses. However, the soap support of the '870 patent is not configured for travel, and thus does not address the issue of preventing the development of soap "goo" while a bar of soap resides within a travel case.

Accordingly, a need exists for a device that replaces the traditional soap travel case or, alternatively, that supplements traditional travel cases. Further, a need exists for a device or system that permits transport of soap while simultaneously preventing the soap from contacting moisture or any pool of water that is arise during such transportation.

BRIEF SUMMARY OF THE INVENTION

A case for a bar of soap is provided herein. The case comprises a base and a lid with a plurality of surfaces. The base includes a receiving portion, and the case is configured to releasably hold and secure a bar of soap in a given vertical and horizontal position. In one embodiment, the bar of soap is attached to a soap support and the case is configured to releasably hold and secure the soap support such that the bar of soap is prevented from contacting the plurality of surfaces, base, lid, or a combination thereof.

The receiving portion can be defined by one or more walls. The case can further comprise at least one locking tab, wherein the locking tab selectively secures a bar of soap in a given vertical position when the case assumes a closed position.

In one embodiment, the receiving portion comprises a contoured surface that is complementary to a contoured surface of the soap support.

The lid can include a means for reversibly securing the bar of soap in a given vertical position when the case assumes a closed position.

A method of supporting a bar of soap within a case is also disclosed herein. The method includes reversibly securing a bar of soap to a soap case, when the bar of soap is attached to a soap support. The method further includes maintaining the bar of soap in a given vertical and horizontal position when the soap case is in a closed position.

BRIEF DESCRIPTION OF THE DRAWINGS

So that the manner in which the present invention can be better understood, certain illustrations, charts and/or flow charts are appended hereto. It is to be noted, however, that the drawings illustrate only selected embodiments of the inventions and are therefore not to be considered limiting of scope, for the inventions can admit to other equally effective embodiments and applications.

DETAILED DESCRIPTION

Definitions

Figure 1:
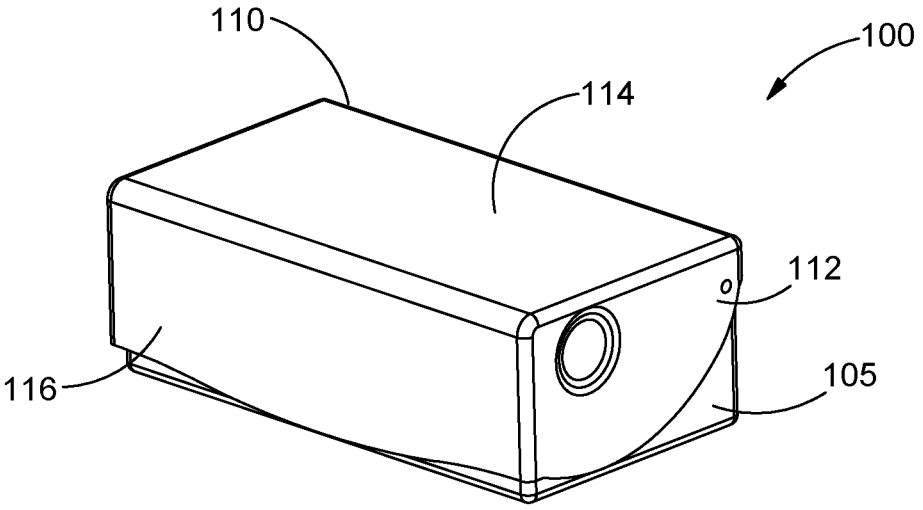
FIG. 1 is a top perspective view of a soap travel case, in one embodiment. In this view, the soap travel case is in a closed position.

The singular forms "a," "an," and "the" include plural reference unless the context clearly dictates otherwise. The use of the word "a" or "an" when used in conjunction with the term "comprising" in the claims and/or the specification can mean "one," but it is also consistent with the meaning of "one or more," "at least one," and "one or more than one."

Wherever any of the phrases "for example," "such as," "including" and the like are used herein, the phrase "and without limitation" is understood to follow unless explicitly stated otherwise. Similarly "an example," "exemplary" and the like are understood to be nonlimiting.

The term "substantially" allows for deviations from the descriptor that do not negatively impact the intended purpose. Descriptive terms are understood to be modified by the term "substantially" even if the word "substantially" is not explicitly recited. Therefore, for example, the phrase "wherein the lever extends vertically" means "wherein the lever extends substantially vertically" so long as a precise vertical arrangement is not necessary for the lever to perform its function.

The terms "comprising" and "including" and "having" and "involving" (and similarly "comprises," "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a process involving steps a, b, and c" means that the process includes at least steps a, b and c. Wherever the terms "a" or "an" are used, "one or more" is understood, unless such interpretation is nonsensical in context.

As used herein the term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

For purposes of the present disclosure, it is noted that spatially relative terms, such as "up," "down," "right," "left," "beneath," "below," "lower," "above," "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device can be otherwise oriented (rotated 90 degrees or at other orientations) and the spatially relative descriptors used herein interpreted accordingly.

As used herein, the term "bar of soap" means any solid cake of surfactant material.

DETAILED DESCRIPTION OF CERTAIN EMBODIMENTS

Detailed descriptions of one or more embodiments are provided herein. It is to be understood, however, that the present invention can be embodied in various forms. Therefore, specific details disclosed herein are not to be interpreted as limiting, but rather as a basis for the claims and as a representative basis for teaching one skilled in the art to employ the present invention in any appropriate manner.

Provided herein in various exemplary embodiments is a soap case configured to releasably secure a bar of soap both vertically and horizontally within the case. Thus, when secured within the soap case, a bar of soap does not contact any surface of the case, even if the case becomes inverted during transport. Furthermore, the presently disclosed embodiments permit air to circulate around the entire surface of the soap to promote drying and prevent the transfer of soap residue to the soap case. In preferred embodiments, the soap travel case is configured to secure the soap both vertically and horizontally when the case is in an enclosed position. The case can be further configured to release the bar of soap from the restraint upon opening of the soap case. In certain embodiments, the soap case automatically secures the soap in a locked vertical and horizontal position upon closing or automatically disengages the bar of soap from horizontal and vertical restraint upon opening. In alternative embodiments, a user manually engages the bar of soap in a secured position or manually disengages the bar of soap from the secured position.

Figure 2:
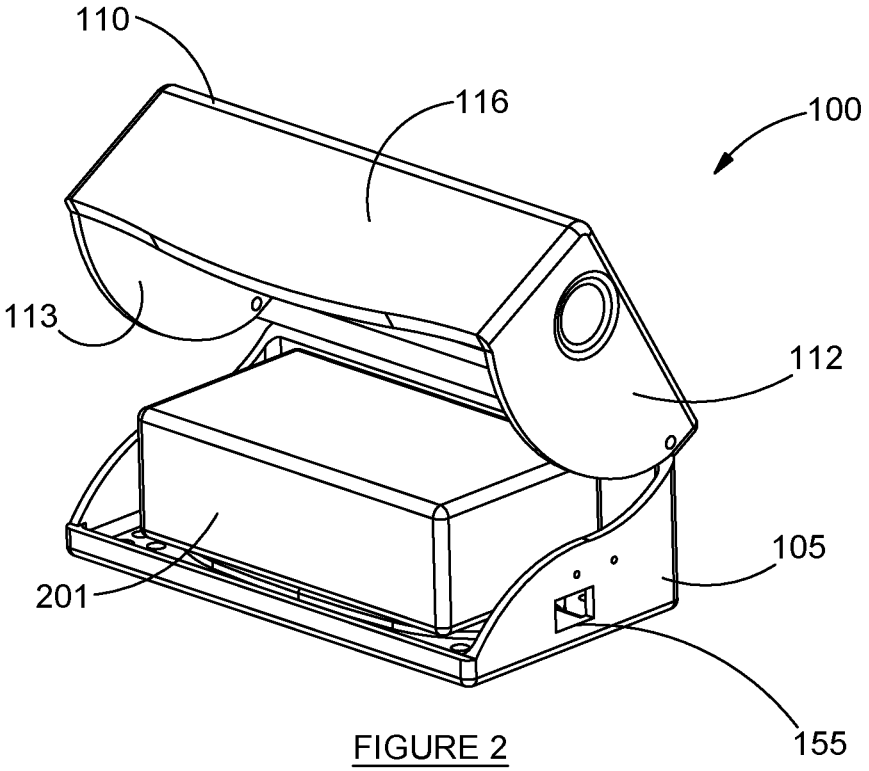
FIG. 2 is another top perspective view of the soap travel case of FIG. 1. Here, the lid is shown partially open to reveal a bar of soap within the case.

FIGS. 1 and 2 provide top perspective views of a soap case 100 in one embodiment. In FIG. 1, a lid 110 is shown in a closed position over a base 105. In FIG. 2, the lid 110 is partially open to reveal the interior of the soap travel case 100. The soap travel case 100 will be introduced with reference to FIGS. 1 and 2 together.

The soap travel case 100 first includes a base 105 and a lid 110. In the arrangement of FIGS. 1 and 2, the lid 110 includes two side walls 112, a top surface 114, a front wall 116, and a back surface (more clearly seen at 118 of FIG. 3A). The lid 110 is shown hingedly attached to the base 105. In alternative embodiments, the lid 110 is capable of being completely lifted off, slid off, or otherwise removed from the base 105.

As shown in FIG. 1, the walls of the lid 112, 114, 116 extend substantially over the base 105 to enclose a bar of soap that is secured therein (201 at FIG. 2). In FIG. 2, the base 105 is shown with a bar of soap 201 reversibly secured thereto. The soap 201 is shown in phantom to partially reveal the mechanism by which the soap is reversibly secured to the base 105 (discussed in more detail below). A locking tab 155 of a locking clip (more clearly seen in FIGS. 3A and 3B at 150), which forms an integral part of the locking mechanism, can be seen extending from a hole, gap, notch, indentation, or groove of the base 105 when the lid 110 is partially open. Also in FIG. 2, an interior surface 113 of one side wall 112 is visible.

Figure 3A:
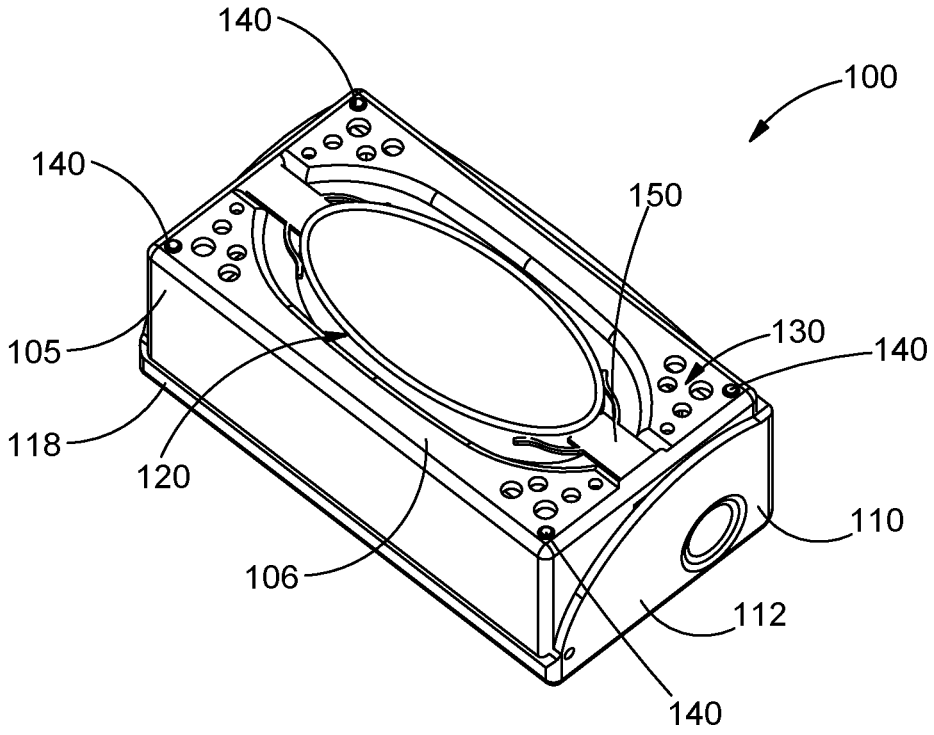
FIG. 3A is a bottom view of the soap travel case of FIG. 1. Here, the bottom surface base is shown with two locking clips embedded therein.

FIG. 3A provides of perspective view of the soap travel case 100 in a closed position and inverted relative to FIG. 1. In the FIG. 3A arrangement, a bottom surface 106 of the base 105 shown. A channel 120 in the bottom surface 106 can be seen and a pair of locking clips 150 is shown residing partially within the channel 120. The walls of the channel 120 define a receiving portion (visible at 170 in the top perspective views of FIGS. 7, 8, and 10) of the soap case 100 that is configured to receive and hold a soap support (220 of FIG. 4) and an associated bar of soap (see 201 at FIGS. 2 & 4-5).

The FIG. 3A embodiment also includes one or more feet 140. The feet 140 reside along the bottom surface 106 of the base 105. The feet 140 are dimensioned to support the base 105 and the soap travel case 100 on a support surface. In the arrangement of FIGS. 3A, the feet 140 are fabricated from a rubber or elastomeric material. This prevents the soap travel case 100 from slipping on the support surface. In embodiments, the feet 140 can be fabricated from the same material as the base 105.

In the arrangement of FIG. 3A, the feet 140 are placed along the bottom corners of the base 105. In alternative embodiments, the feet can be placed at any location or at any interval along the bottom surface 106 of the base 105. In this embodiment, all of the feet 140 have the same height.

It is understood that the bottom surface 106 can have more or fewer feet 140 than that pictured in FIG. 3A. It is also understood that the feet 140 can have a circular (or arcuate) profile or a polygonal profile.

A plurality of ventilation holes 130 is also visible in FIG. 3A embodiment. The ventilation holes 130 allow air to access a bar of soap (seen at 201 in FIGS. 2 and 4-6) when the bar of soap is enclosed within the soap case 100. In the FIG. 3A embodiment, the ventilation holes 130 are substantially circular and are shown at each of the corners of the bottom surface 106 of the soap support 100. However, it is understood that these are merely illustrative and that any number, shape, size, or arrangement of ventilation holes 130 can be provided. Certain embodiments do not comprise ventilation holes 130.

Figure 3B:
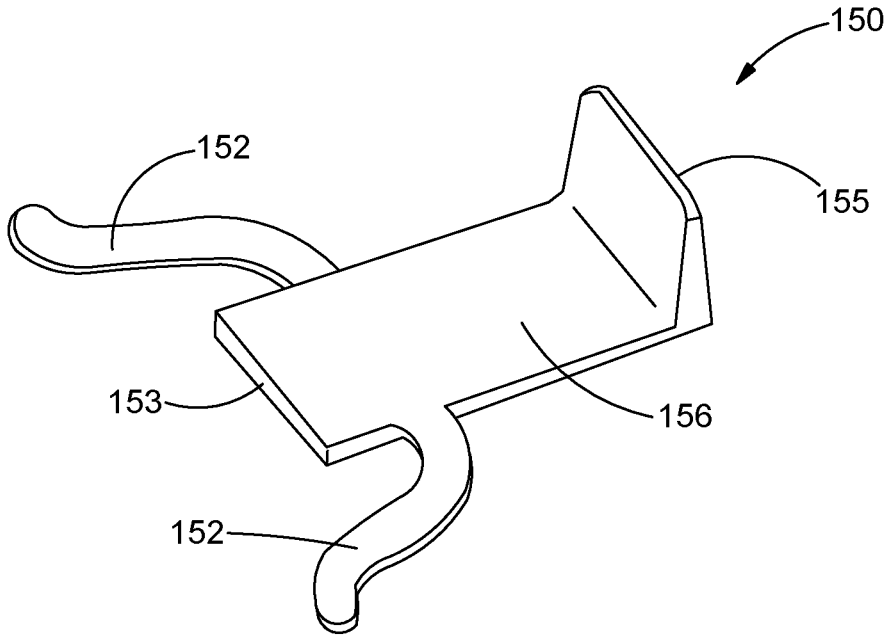
FIG. 3B presents a spring-loaded locking clip removed from the base of the soap travel case, under one embodiment.

FIG. 3B shows an enlarged view of the locking clip 150 of FIG. 3A removed from the soap travel case 100. The locking clip 150 comprises a body 156 that is integrally connect to a locking tab 155 and includes two radial spring arms 152. A protrusion extends beyond the point of attachment of the spring arms 152 to from a flange 153 that acts in concert with a soap support (shown at 220 in FIG. 4) to secure a bar of soap to the base 105 of the soap travel case 100.

Figure 4:
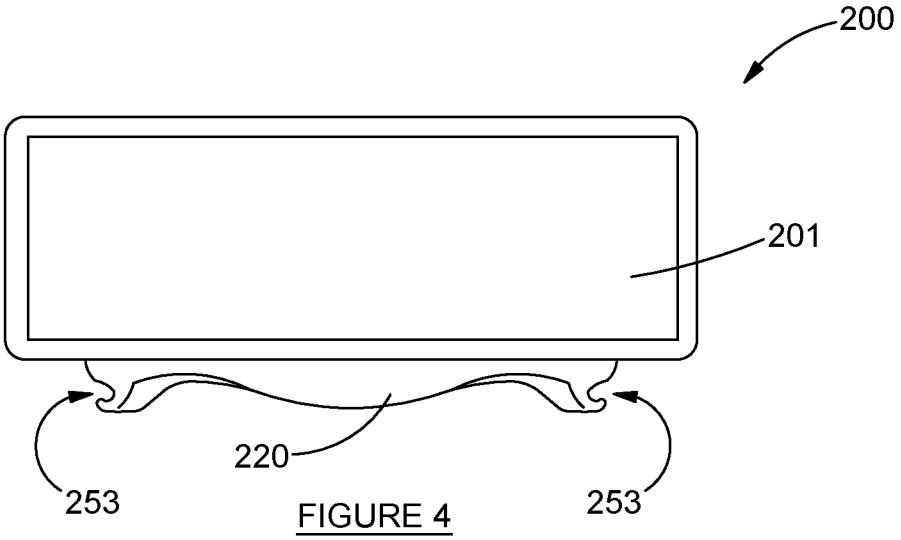
FIG. 4 shows an off-the-shelf bar of soap connected to a soap support in one embodiment. Two illustrative locking notches are visible in the soap support.

FIG. 4 shows an off-the shelf bar of soap 201 attached to a soap support 220. In this embodiment, the soap support 220 comprises at least one locking notch 253 configured to receive the flange 153 of the locking clip 150. In this embodiment, the soap support 220 comprises a sinusoidal shape that continues around the soap support 220.

Figure 5:
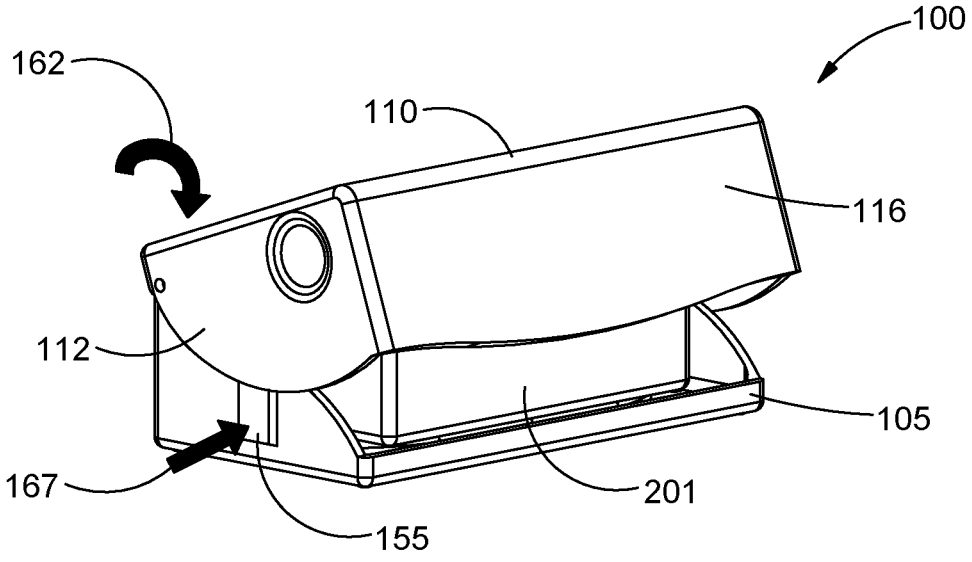
FIG. 5 is another top perspective view of the soap travel case of FIG. 1. The lid is shown closing over a bar of soap.

FIG. 5 reveals another top perspective view of the soap travel case 100, wherein the lid 110 is moved in the direction of arrow 162 to a closed position. As the lid moves in the direction of arrow 162, the interior surface (seen at 113 of FIG. 2) of the side wall 112 presses against the locking tab 155 such that the locking clip 150 moves in the direction of arrow 167. Thus, when fully closed, the flange 153 of the locking clip 150 is maximally extended into the receiving portion (170 of FIGS. 7, 8, and 10) of the base 105. When so situated, the flange 153 is positioned to engage the at least one locking notch 253 of a soap support 220 resting within the receiving portion (170 of FIGS. 7, 8, and 10) of the base 105 (more clearly shown in FIG. 6). As shown in the FIG. 5 embodiment, the locking tab 155 can be tapered or generally triangular such that the thickness of the tab 155 increases with proximity to the body 156 of the locking clip 150 (more clearly seen in the tab 155 of FIG. 6).

Figure 6:
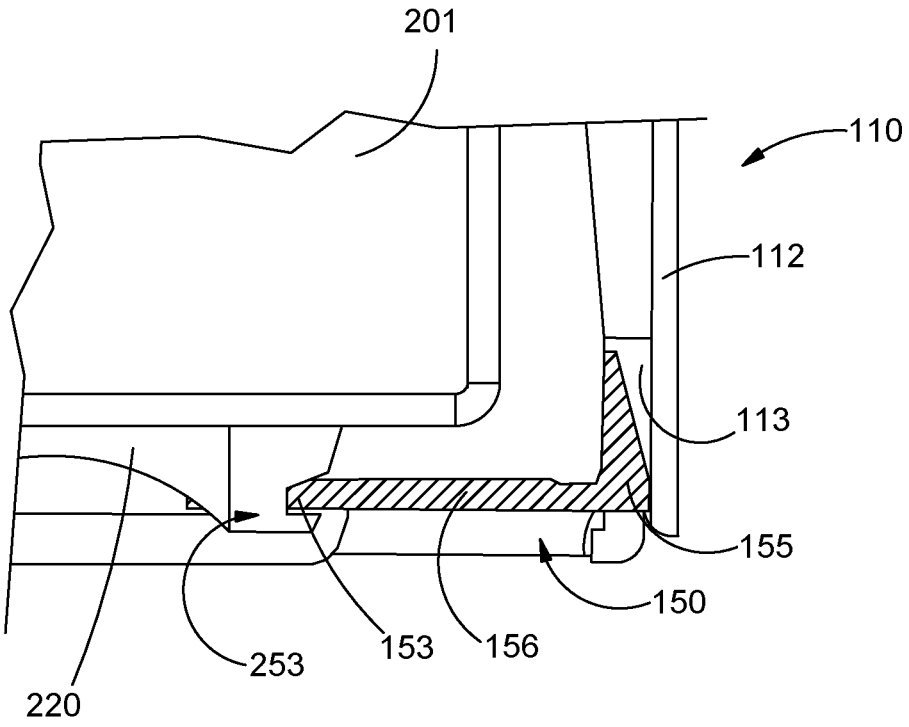
FIG. 6 is a cross-sectional, enlarged view of the locking mechanism used in the exemplary soap case of FIG. 1. A locking clip is shown extending into the locking notches of the soap support of FIG. 4.

FIG. 6 provides a cross-sectional, enlarged view of the corner of a closed soap support under one embodiment. FIG. 6 shows the locking mechanism used in the exemplary soap case of FIG. 1. As shown, the lid 110 is closed, and the interior surface 113 of the side wall 112 has fully depressed the tab 155 of the locking clip 150 such that the flange 153 of the locking clip 150 is maximally extended into the receiving portion (170 of FIGS. 7, 8, and 10) of the base to engage the at least one locking notch 253 of the soap support 220. When so disposed, the soap support 220 and the soap 201 tethered thereto are secured both horizontally and vertically within the soap travel case 100. Thus, the soap 201 is prevented from sliding within the case 100 and remains in a constant position within the case 100. Importantly, this prevents the soap from contacting any of the various interior surfaces of the soap case 100, and, hence, the soap avoids contact with any water or moisture that can pool or otherwise collect on such interior surfaces. In addition, all faces of the soap 201 are exposed to air to accelerate drying of the soap 201 and prevent the formation of "goo" between uses.

The use of locking tabs 150 as shown in the FIGS. 5 & 6 embodiments is merely exemplary. The soap case 100 can have any number of locking tabs suitable to secure a bar of soap 201 in a fixed horizontal and vertical position. Embodiments can comprise up to ten locking tabs. Certain embodiments comprise between one and five locking tabs. Further, the location of the locking tabs may vary in alternative embodiments. The locking tabs can be placed on the sides (as shown in FIGS. 2, 3A, 5, and 6) or the locking tabs can be on the front or back of the soap case 100. In one embodiment, a single locking tab is placed along either of the sides, the front, the back, or the undersurface of the soap case 100.

Figure 7:
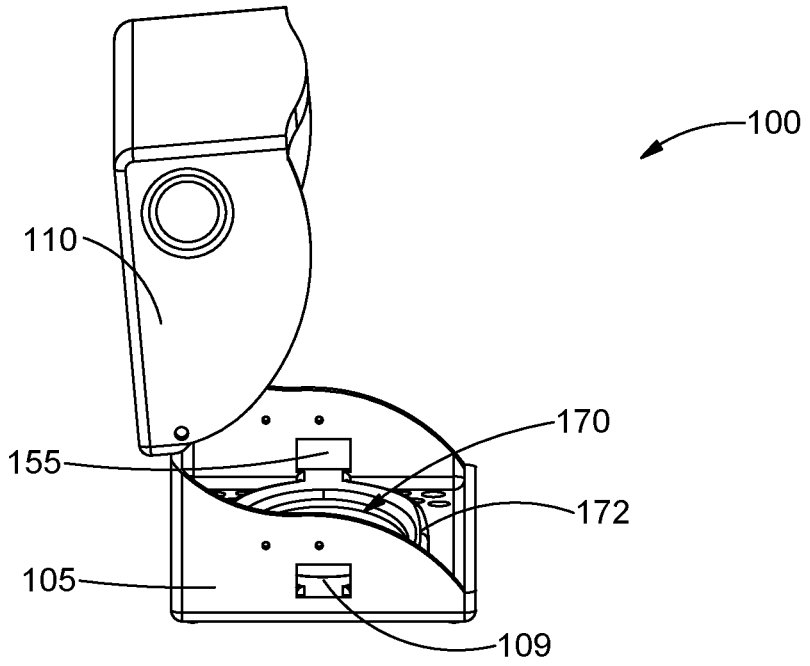
FIG. 7 provides a photographic side perspective view of a soap case with locking tabs, under one embodiment.
Figure 14:
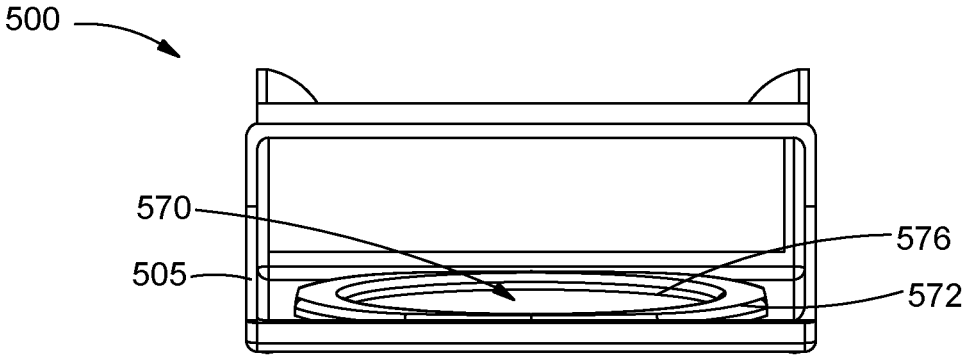
FIG. 14 is a front view of the soap case of FIG. 11.

FIG. 7 presents a side view of a soap travel case 100 under one embodiment. The soap case is shown without an associated soap support or bar of soap. The receiving portion 170 is enclosed within a continuous wall 172 that is formed from the channel 120 that is visible from the undersurface 106 of the soap case (see FIGS. 3A and 9). The tab 155 of a single locking clip 150 is shown on one side of the case 100, while the locking clip is removed from the opposite side of the case to reveal the hole, gap, notch, indentation, or groove 109 through which the tab of the locking clip would otherwise extend. As shown, the floor 175 of the receiving portion is flat. However, in alternative embodiments, the floor 175 can comprise a shape or texture that is complementary to that of the soap support (220 of FIG. 4). In embodiments wherein the shape or texture of the floor is complementary to that of the soap support 220, the floor 175 and the walls 172 of the receiving portion 170 provides additional support to the soap support and can further prevent at least the horizontal displacement of the soap support and associated bar of soap during transport. (See FIGS. 11, 12, & 14).

Figure 8:
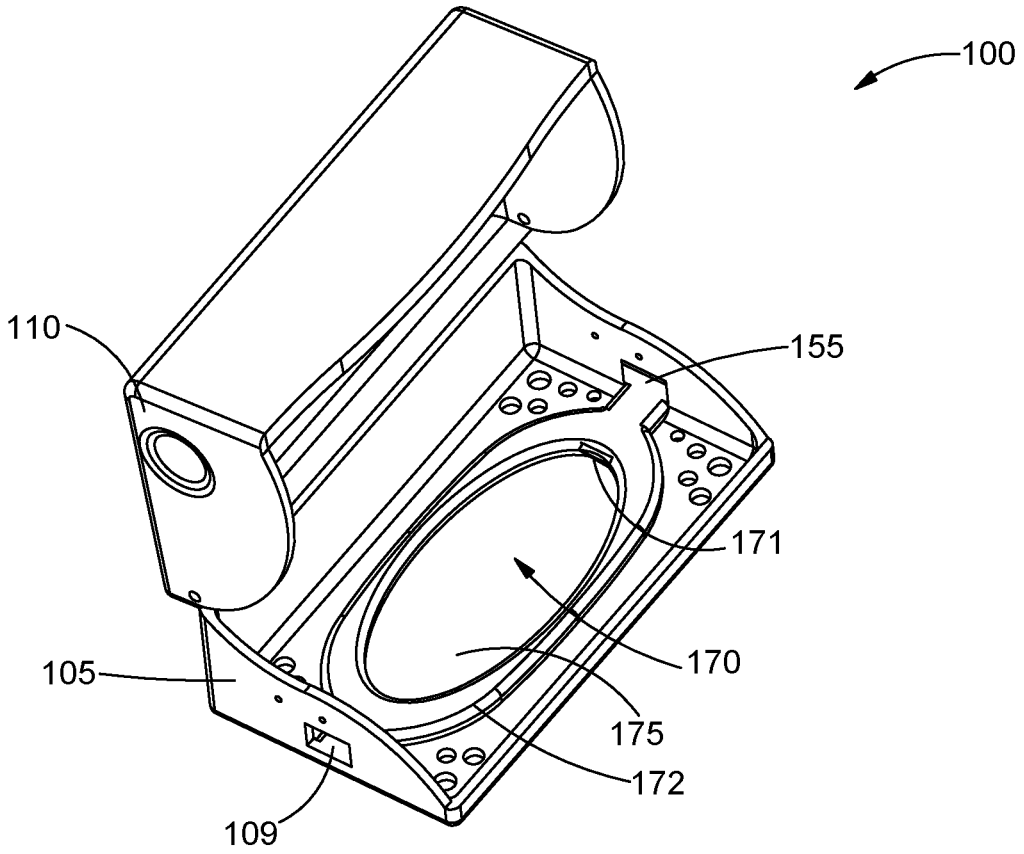
FIG. 8 is a photographic top perspective view of the soap case of FIG. 7.

FIG. 8 is a top, perspective view of the case of FIG. 7. In this view, the receiving portion walls 172 define an oval-shaped receiving portion 170 configured to receive the soap support and bar of soap attached thereto. Also visible in this view is the opening 171 through which the flange (153 of FIG. 3B) of the locking clip 150 extends to vertically and horizontally secure a soap support (220 of FIG. 4) when the lid 110 of the soap case 100 is in a closed position.

The oval shape of the receiving portion 170 is merely exemplary. The receiving portion 170 can assume any shape that is complementary to that of the soap support. The receiving portion 170 can be polygonal, circular, or elliptical. Polygonal embodiments can have sharp or rounded corners. The receiving portion 170 can be in the shape of a rectangle, triangle, square, pentagon, hexagon, heptagon, octagon, nonagon, or decagon. Embodiments of the receiving portion have more than 10 sides.

Figure 9:
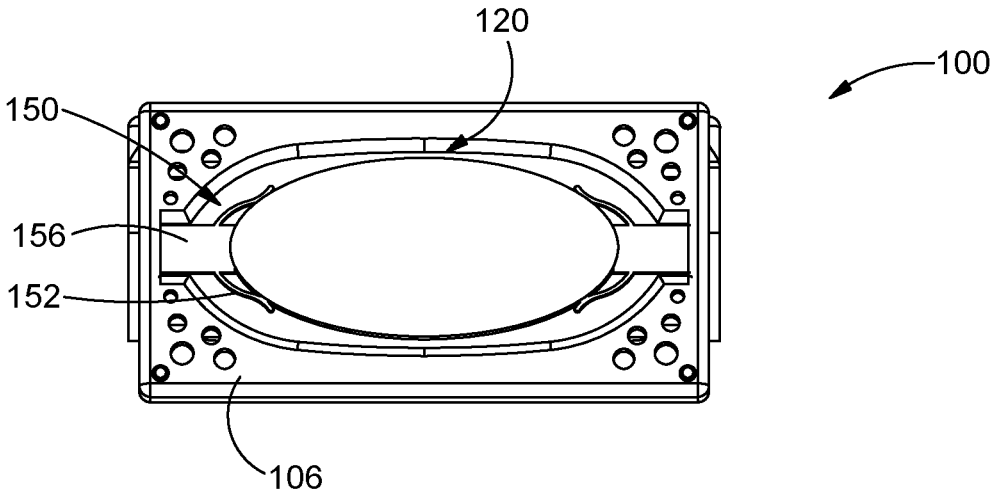
FIG. 9 presents a photographic view of the bottom surface of the soap case of FIG. 7.

FIG. 9 provides a photographic view of the bottom surface 106 of the FIG. 7 embodiment. The oval-shaped channel 120 that defines the receiving portion can be seen, and the body 156 and radial spring arms 152 of the locking clip 150 are also visible.

Figure 10:
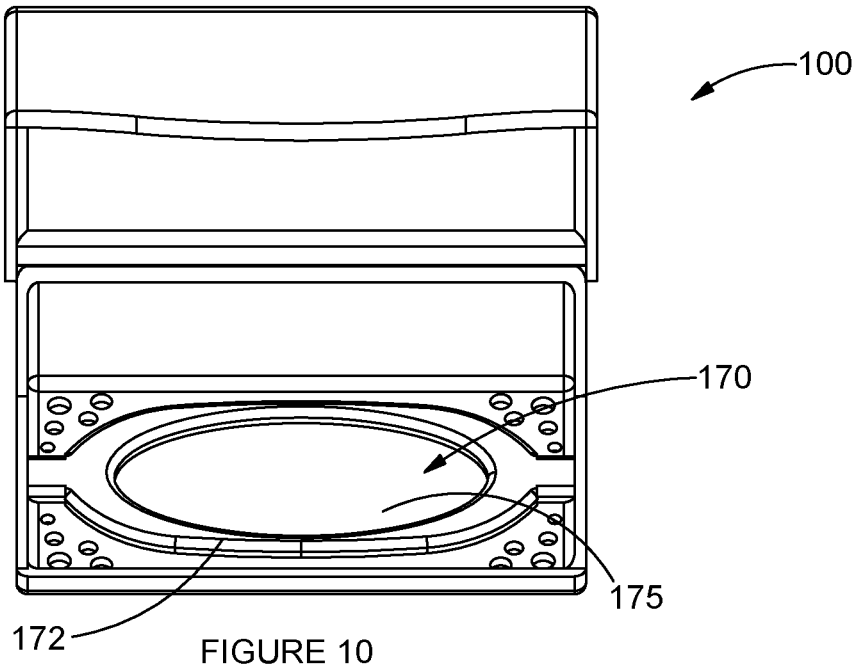
FIG. 10 provides an alternative top perspective view of the soap case of FIG. 7.

FIG. 10 is an alternative top perspective view of the soap case 100 of FIG. 7. The receiving portion 170, walls of the receiving portion 172, and the floor of the receiving portion 175 are clearly seen.

Figure 11:
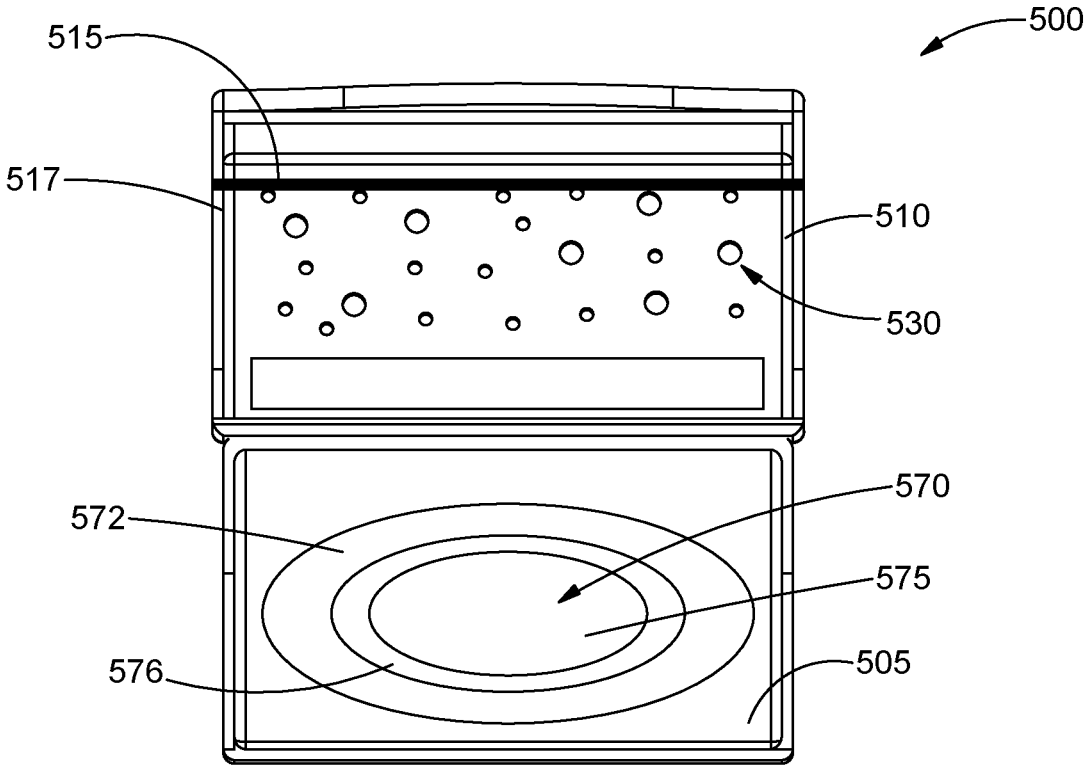
FIG. 11 is a top photographic view of a soap case under an alternative embodiment. The case is shown open with a vertical tension band across the lid.

FIG. 11 provides a top view of a soap travel case 500 in yet another embodiment. The soap case 500 is shown in an open position to reveal the receiving portion 570 of the base 505 of the soap case 500. The receiving portion 570 is defined by a continuous wall 572. The floor 575 of the receiving portion 570 also includes a shaped or contoured region 576, which, in operation, serves to secure a soap support horizontally within the soap case 500. In this embodiment, the shaped or contoured region 576 is complementary to the sinusoidal pattern of a soap support (see 220 of FIG. 4); however the shaped or contoured region 576 can be in the form of any shape, as long as at least a portion of the region 576 is complementary to the shape of an associated soap support. Also in the FIG. 11 embodiment, a tension band 515 is shown extending across the inside of the lid 510. This tension band 517 is held in place by a hole, notch, groove, or gap 517 in the lid 510. In operation, the tension band 517 is configured to provide vertical support to prevent a bar of soap from moving in a vertical orientation. Thus, in this embodiment, the tension band 515, the shaped or contoured region 576 of the receiving portion 570, and the walls 572 of the receiving portion 570 work in concert to secure a bar of soap both vertically and horizontally within the soap travel case 500. In this manner, the soap is prevented from contacting the surface of the case 500 which promotes rapid drying of the soap within the case and prevents the formation of soap "goo."

Figure 12:
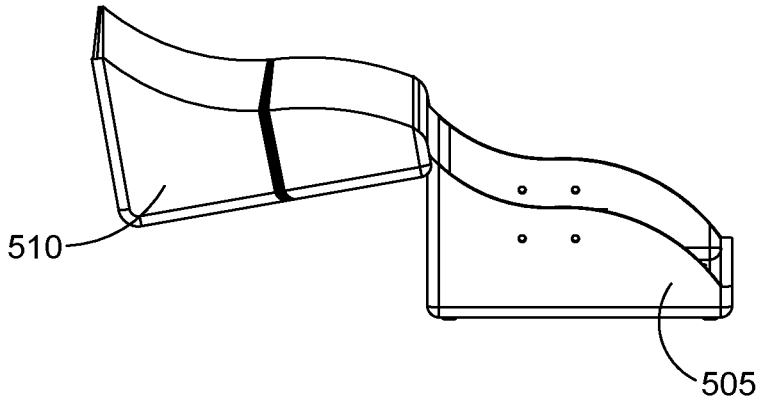
FIG. 12 is a side perspective view of the soap case of FIG. 11.

FIG. 12 provides a side view of the FIG. 11 embodiment. The lid 510 and the base 505 are shown as the soap case 500 rests in an open position.

Figure 13:
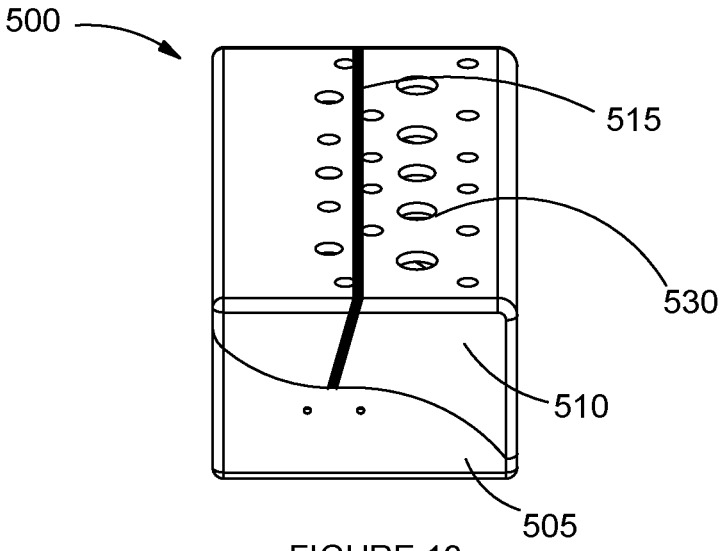
FIG. 13 is a top perspective view of the soap case of FIG. 11 in an enclosed position.

FIG. 13 is a top perspective view of the soap case 500 of FIG. 11 in a closed position. A plurality of ventilation holes 530 can be seen extending through the top surface of the lid 510. In this embodiment, the tension band 515 extends across the top surface of the lid 510. In alternative embodiments, the tension band 515 does not extend over the top portion. The tension band 515 can be anchored to the interior surface of the soap case 500 or can run through a channel that is disposed within the interior of the lid 510.

Figure 15A:
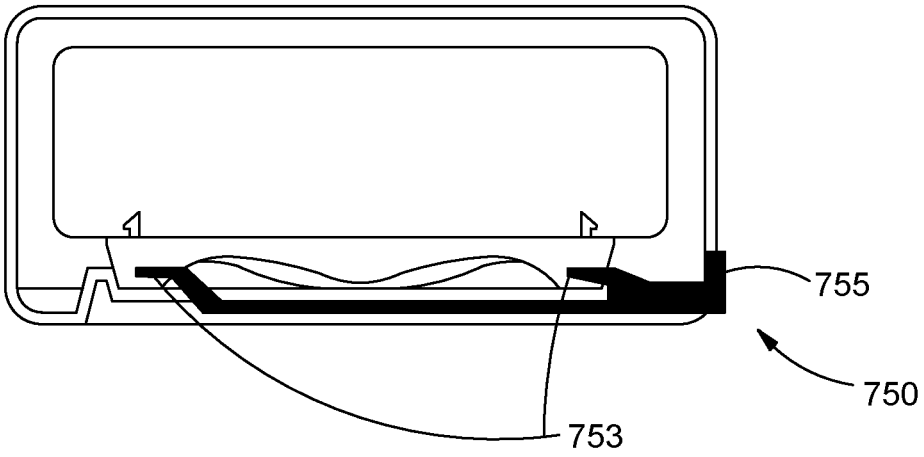
FIG. 15A and FIG. 15B provide side, cross-sectional views of a soap travel case and reveal an exemplary locking mechanism under an alternative embodiment.
Figure 15B:
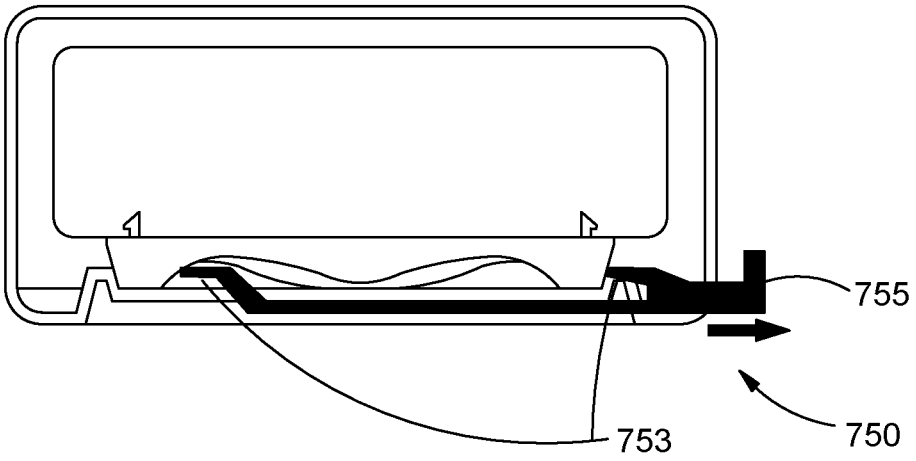

FIG. 15 is a side, cross-sectional view of a soap case in an alternative embodiment. The locking mechanism of the FIG. 15 embodiment comprises a locking clip 750 with two flanges 753 and a locking tab 755 that are integral with the locking clip 750. FIG. 15A shows the locking clip 750 engaged in a locked position. As shown, the flanges 753 of the clip 150 engage the locking notches of the soap support such that the soap support and the associated soap are locked in position within the case. As shown in FIG. 15B, when the locking tab 755 is moved in the direction of the arrow, the flanges 753 of the locking clip 750 disengage from the soap support, and the soap/soap support complex can be removed for use.

Figure 16A:
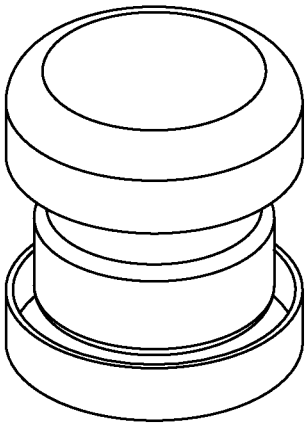
FIG. 16A and FIG. 16B show exploded perspective views of a substantially circular travel case under one embodiment.
Figure 16B:
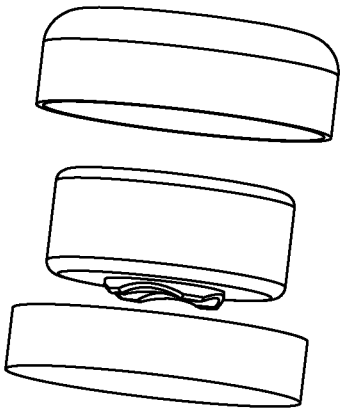

FIG. 16A provides a top perspective view of a soap travel case under a substantially circular embodiment. The lid of the soap case is shown exploded above the bar of soap and the base of the soap case. The circular bar of soap is shown in phantom to reveal a circular soap support with the floor of the travel case. FIG. 16B shows a bottom perspective view of the soap travel case of FIG. 16A with the soap and soap support exploded away from the base of the soap case.

Figure 17:
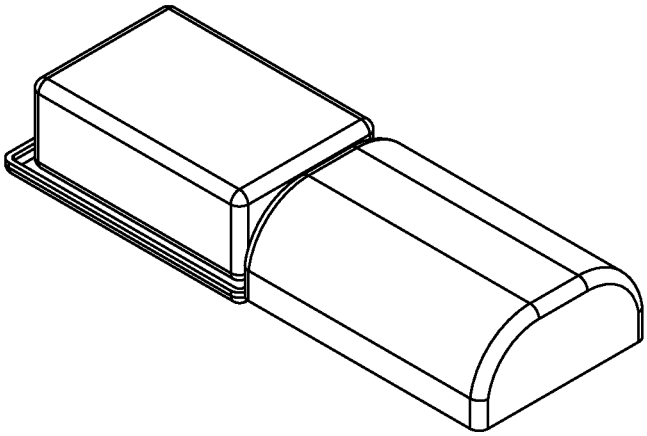
FIG. 17 provides a perspective view of a soap travel case with a sliding lid under one embodiment.

FIG. 17 shows another embodiment of the soap travel case. In the FIG. 17 embodiment, the lid of the soap case is configured to slide off of the base of the soap case.

Figure 18:
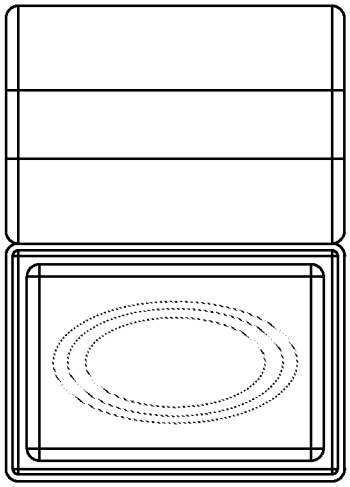
FIG. 18 shows a top view of a soap travel case with a sliding lid in an alternative embodiment. The bar of soap is shown in phantom to reveal the floor of the travel case.

FIG. 18 provides a top view of another embodiment wherein the lid of the soap case slides off of the base in an alternative direction. A bar of soap is shown in phantom to reveal the soap support residing within or upon the floor of the soap support case.

Figure 19:
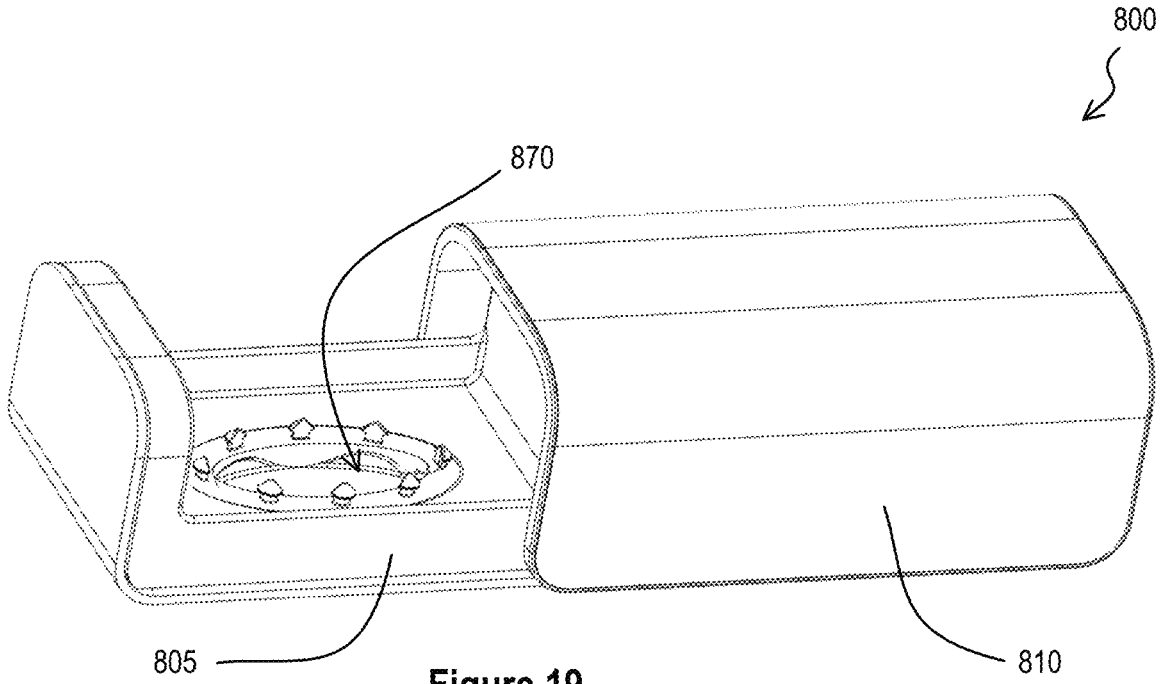
FIG. 19 shows a top perspective view of a soap travel case with a sliding lid under another embodiment. The lid is shown open to reveal the base with a soap support stand disposed therein.

FIG. 19 shows another embodiment of a soap travel case 800 with a sliding lid 810. The lid 810 is shown in an open position over the base 805. A soap support 220 can be seen within the walled receiving portion 870 of the base 805.

Figure 20:
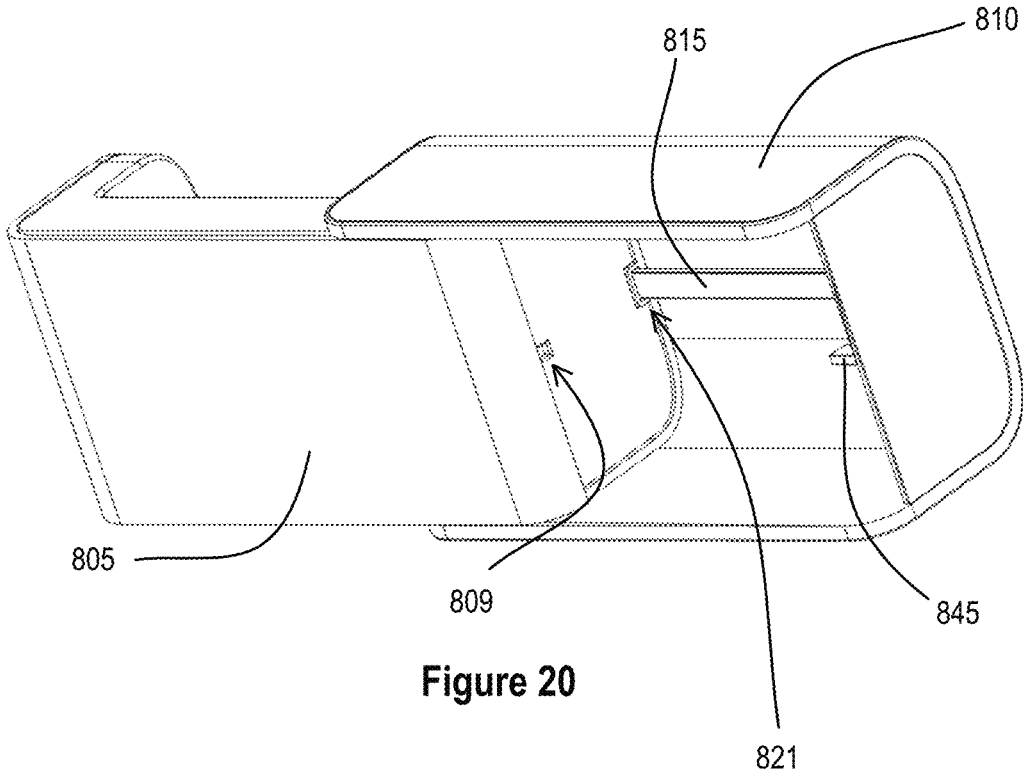
FIG. 20 provides a bottom perspective view of the sop travel case of FIG. 19.

FIG. 20 is a bottom perspective view of the soap case 800 of FIG. 19. The underside of the lid 810 is shown, and a securing bar 815 can be seen extending longitudinally across at least a portion of the lid 810. In the FIG. 20 embodiment, a protuberance 845 extends inwardly from the back wall of the lid 810. A hole, gap, notch, indentation, or groove forms a receiving slot 809 near the bottom of in the back wall of the base 805. The receiving slot 809 of the base can be aligned to receive the protuberance 845 of the lid 810. The top portion of the base 805 can also include a channel 821 configured to receive the securing bar 815 of the lid such that, when disposed therein, the securing bar 815 prevents the lid from falling off of the base 805. In embodiments, the securing bar 815 is integral with the lid 810.

Figure 21:
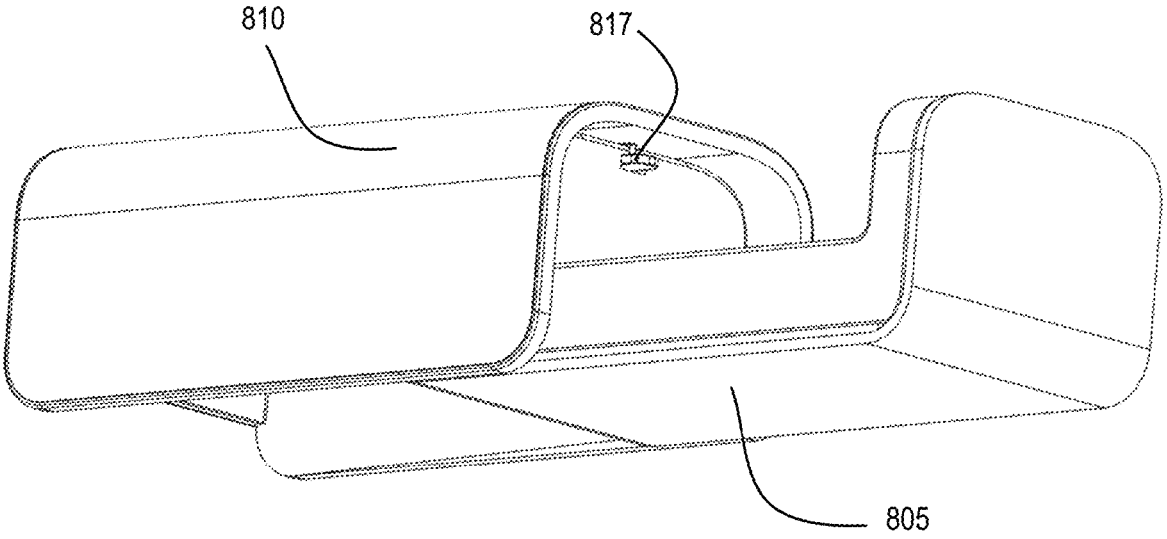
FIG. 21 shows a front side perspective view of the soap travel case of FIG. 19.

FIG. 21 provides a side, front perspective view of the soap case 800 of FIG. 19. A latch 817 is shown extending out of the channel 821 of the base 805. The latch 817 can be integral with securing bar 815. In embodiments, the latch 817 is an extension of the securing bar 815. Alternatively, the latch 815 may be connected directly to the lid 810.

Figure 22:
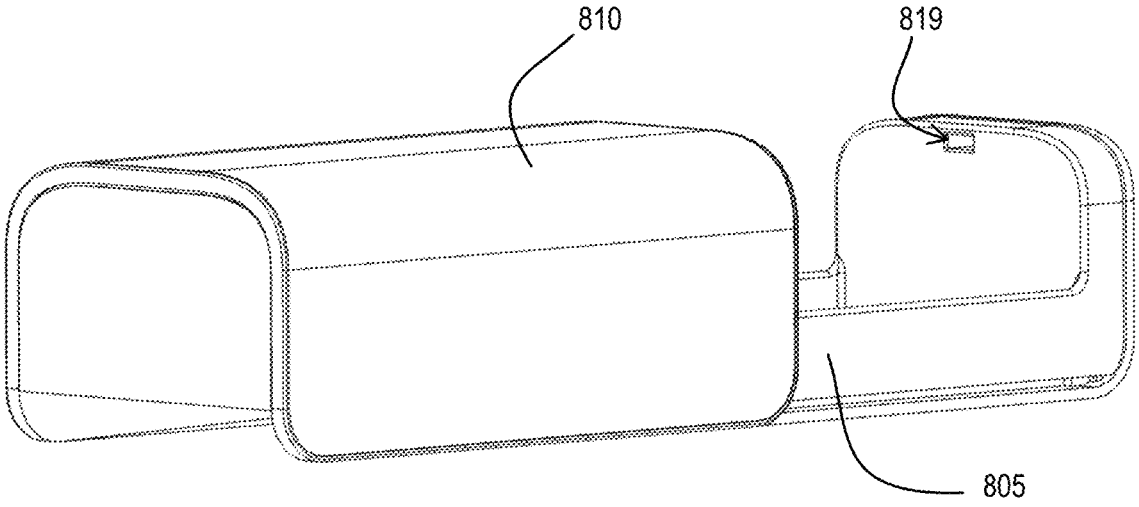
FIG. 22 shows a back side perspective view of the soap travel case of FIG. 19.

FIG. 22 shows a back, side perspective view of the soap case 800 of FIG. 19. A latch receiver 819 in the form of a hole, gap, notch, indentation, or groove can be seen on the interior back wall of the base 805. In operation, the latch receiver 819 is configured to receive the latch 817 of the lid 810 to assist with securing the lid 810 in a closed position.

Figure 23:
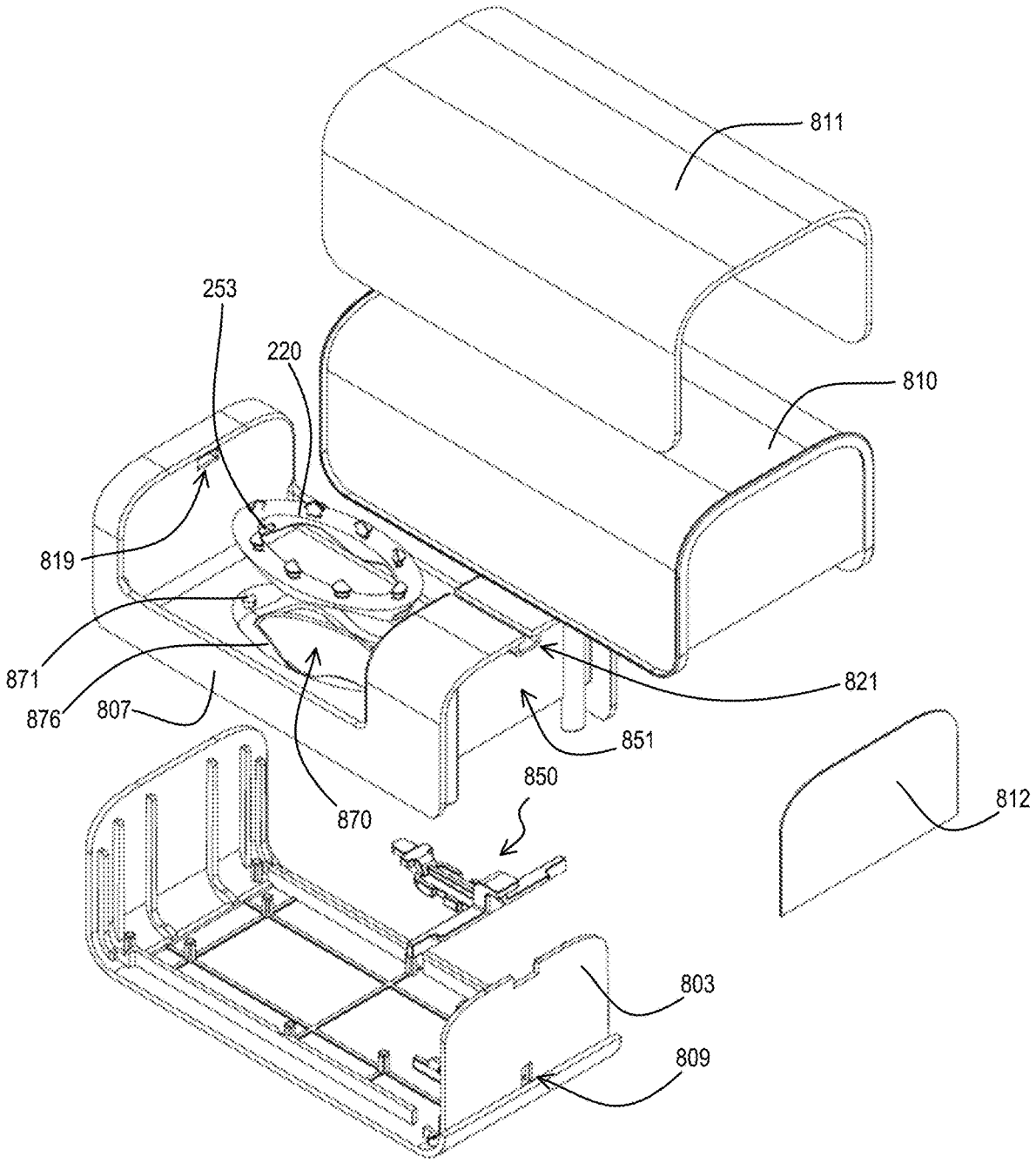
FIG. 23 provides an exploded view showing various components of the soap travel case of FIG. 19.

FIG. 23 provides an exploded view of the soap case of FIG. 19. The base 805 is shown separated into a base insert 807 and a lower base plate 803. In embodiments, the base insert 807 and the base plate 803 are interconnected to form the base 805. The base insert 807 and the base plate 803 are shown as connected via rods that extend from the base insert 807 into rod receivers of the base plate 803. In certain embodiments, the base insert 807 and the base plate 803 can be further secured via screws or similar fasteners to form one base piece 805. The various parts of the base 805 can be secured together via any mechanism known to those of skill in the art. In certain embodiments, the base 805 is made of a single, integrated piece of material. The base insert further includes a walled receiving portion 870 that is configured to receive and hold a soap support 200 therein. The walled receiving portion can comprise a securing knob 871 that is configured to interact with at least one locking notch 253 within the soap support 220 to assist with securing the soap support 220 within the soap case 800.

A locking clip 850 is shown exploded apart from the base plate 807. The locking clip 850 can be disposed within a locking clip chamber 851 of the base insert 807. In the FIG. 23 embodiment, a decorative lid cap 811 and a decorative side plate 812 are shown exploded away from the lid 810. Certain embodiments lack a decorative lid cap or a decorative side plate. Certain embodiments will lack both the decorative lid cap and the decorative side plate.

Figure 24:
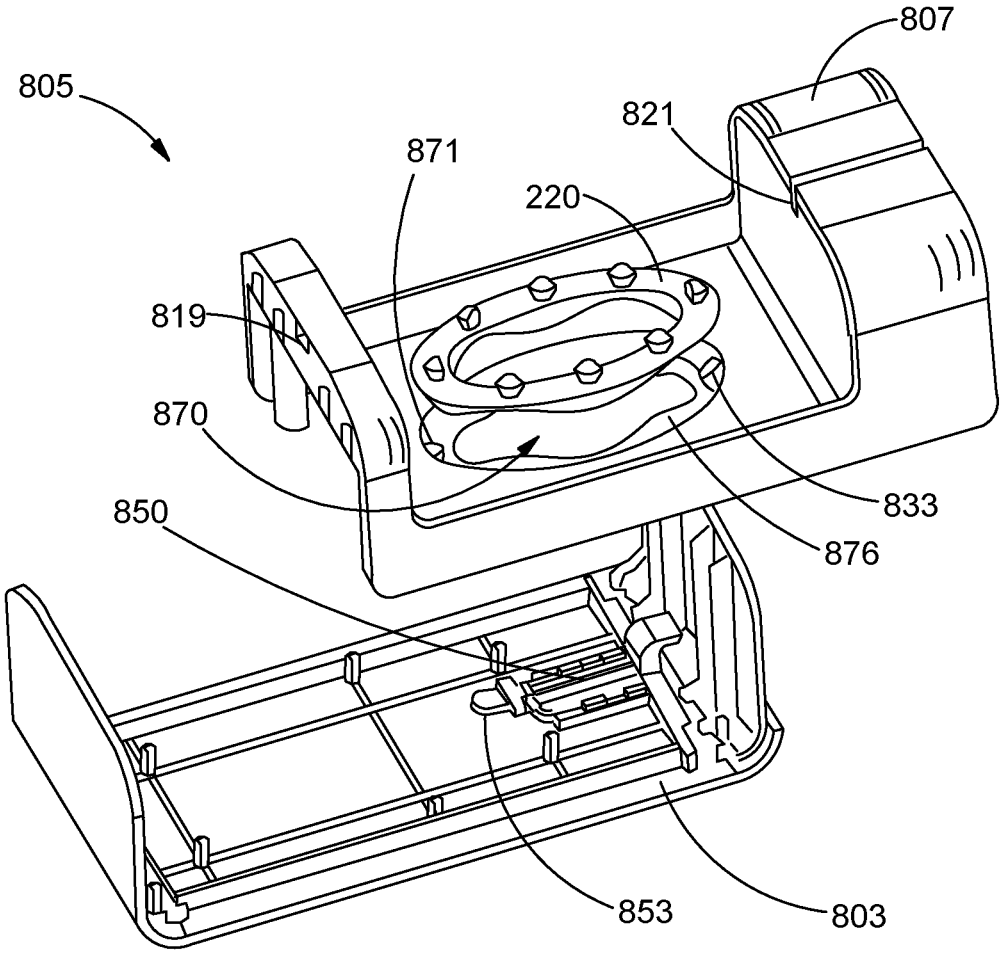
FIG. 24 shows a partially exploded, top perspective view of the soap travel case of FIG. 19.

FIG. 24 shows a close up view of the base exploded into its constituent parts under one embodiment. The base insert 807 is shown hovering over the lower base plate 803, and the locking clip 850 is shown disposed within the lower base plate 803. A soap support 220 is shown hovering above the walled receiving portion 870 of the base 805. As shown in the FIG. 24 embodiment, the walled receiving portion 870 comprises a contoured surface 876 that is complementary to the shaped surface of the soap support 220. The walled receiving portion can also include a flange pass-through 833, which is configured to permit the flange 853 of the locking clip 850 to pass there through when the soap case assumes a closed position (discussed in more detail below). The flange pass-through 833 can be configured to be aligned with a locking notch 253 of the soap support 220.

Figure 25:
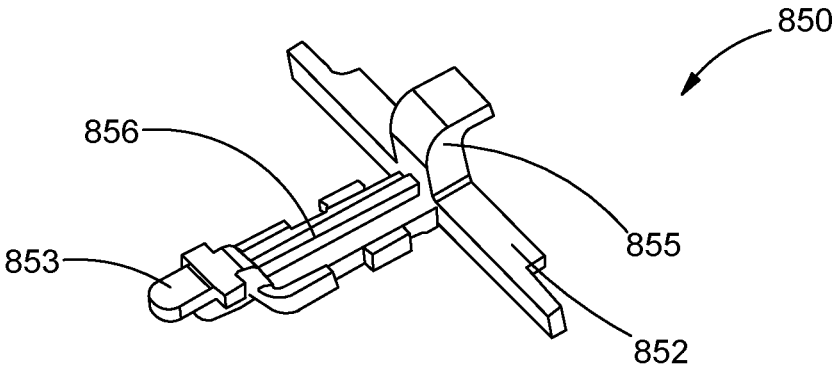
FIG. 25 provides a perspective view of a locking clip isolated from the FIG. 19 embodiment.

FIG. 25 shows an enlarged view of the locking clip 850 of FIGS. 23 & 24 isolated from the soap travel case 800. The locking clip 850 comprises a body 856 that is integrally connect to a locking tab 855 and includes a crossbeam 852. A protrusion extends distally beyond the body 856 to form a flange 853 that acts in concert with a soap support (shown at 220 in FIGS. 24 and 26) to secure a bar of soap to the base 805 of the soap travel case 800 when the lid 810 is closed.

Figure 26:
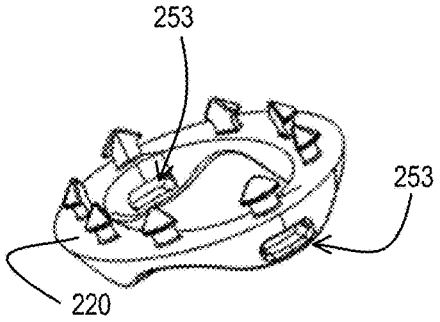
FIG. 26 is top perspective view of an exemplary soap support for use in the FIG. 19 embodiment.

FIG. 26 provides a soap support 220 that is suitable for use in various embodiments of the present invention, including the embodiments of FIGS. 19-25. The soap support 220 is shown with two locking notches 253. Certain embodiments will comprise only a single locking notch 253. Embodiments comprise more than two locking notch 253.

Figure 27:
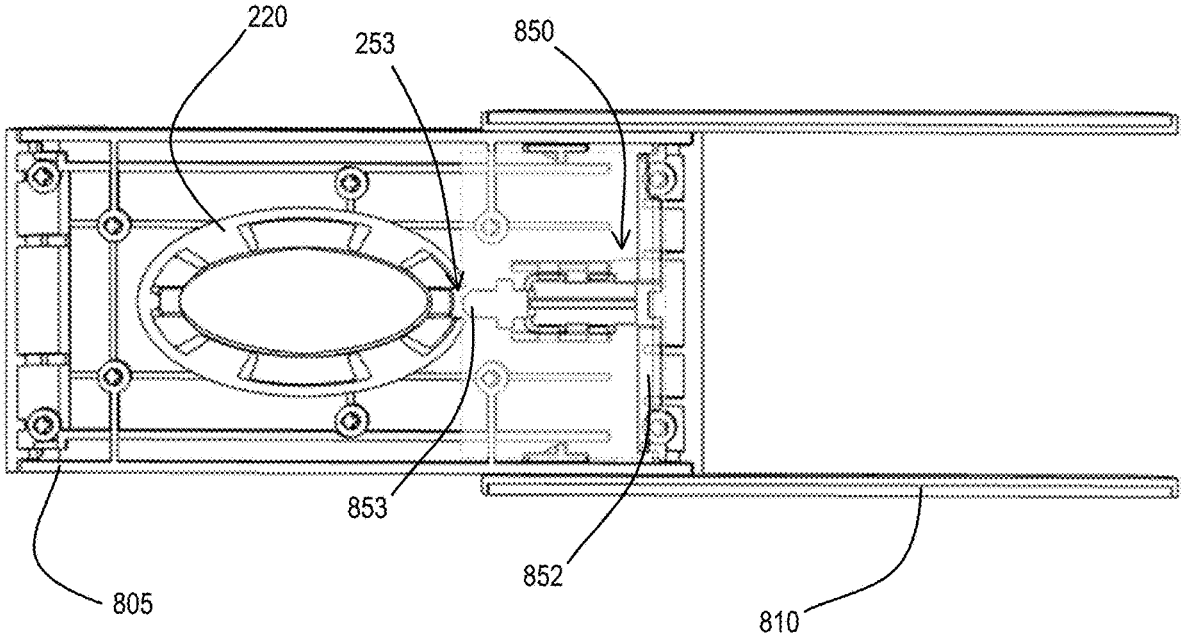
FIG. 27 is a top cross-sectional view of the soap case of FIG. 19. The cross section is taken along the longitudinal axis at the level of the locking notch of the soap support to reveal an exemplary locking mechanism of FIG. 19.

FIG. 27 provides a top, cross-sectional view of the soap travel case of FIGS. 19-25 with the lid 810 in an open position. The cross section is taken through the plane of the case 800 and soap support 220 that contains the locking notches 253 of the soap support 220. The locking clip 850 is shown in phantom, with the flange 853 aligned with the locking notch 220 of the soap support 220. As can be seen, the flange 853 is not inserted into the locking notch 253 of the soap stand 220, making the soap stand and the associated soap bar (not shown) free for removal by the user. However, when the flange 853 is inserted within the locking notch 253, the soap support 220 is in a lock position within the case 800 and is secured both horizontally and vertically therein.

In operation of the soap case 800 of FIGS. 19-27, the soap support 220 is secured into its horizontal and vertical position when the soap support 220 is disposed within the walled receiving portion 870 and the lid 810 of the soap case 800 is in a closed position. When the lid 810 assumes an open position, the soap support 200 is free from the secured position, permitting a user to remove the a bar of soap (not shown) that is attached to the soap support 220 (see FIG. 27). In embodiments, the closing of the lid 810 causes the protuberance (845 at FIG. 20) of the lid 810 to pass horizontally into and through the receiving slot (809 of FIGS. 20 and 23) of the base 805. Upon passing there through, the protuberance 845 contacts the crossbeam 852 of the locking clip 850 and pushes the flange 853 through the flange pass-through 833 of the base and into the locking notch 253 of the soap support 220, securing the soap support 220 within the case 800 when the case is fully closed. When in the closed position, depression of the crossbeam 852 by the protuberance 845 flexes the crossbeam 852, creating a cantilever bending force that is stored as potential energy. Upon opening of the case 800, the protuberance 845 is pulled away from the crossbeam 852, releasing the stored potential energy as a spring force, and the locking tab 850 moves out of the locking notch 253 to free the soap support 220 for removal by a user.

Although a tension band 515, locking clips 150, 850, a walled receiving portion 170, 570, 870 a contoured floor 176, 576, 876 or a combination thereof are employed in the exemplary embodiments previously described herein, alternative mechanisms exist for horizontally and vertically securing the soap support 220 and associated bar of soap 201. By way of non-limiting example, a spring can descend from the inner surface of the lid to prevent vertical movement of the soap when the soap case is in a closed position or the soap support and associated bar of soap can be anchored to the base of the soap support by alternative means. Under one embodiment, the travel case comprises one or more grooves or tabs that permit the soap support and associated bar of soap to be secured into a given position by inserting the soap support into the receiving portion and maneuvering or twisting the support into a locked position. In another embodiment, the soap case comprises a mechanism that permits locking and unlocking of the soap and soap support through depression of a button or the release of a clasp.

The soap case can be configured to automatically release the soap and associated soap support from a secured horizontal and vertical position (e.g. releases upon opening of the case) or the soap case can be configured to require manual release of the soap and soap support from the secured horizontal and vertical position. Under one aspect, the user manually disengages the soap and associated soap support by sliding a tab, twisting the soap or soap support, or "popping" the soap and soap support out of a locked position. In one embodiment, the user depresses a button to release the soap and soap support from a locked position.

Similarly, the soap case can be configured to automatically secure the soap and support into a locked horizontal position (e.g. secures in a locked position up closing of the case) or the soap case can be configured to require manual locking of the soap and soap support into a secured horizontal and vertical position. Under one aspect, the user manually engages the soap and associated soap support into a locked horizontal and vertical position by sliding a tab, twisting the soap or soap support, or snapping the soap support into a locked position. In one embodiment, the user depresses a button to secure the soap and soap support in the locked position.

The soap travel case 100, 500, 800 is preferably fabricated from a substantially rigid material such as a hard polycarbonate material, a ceramic material, or metal. However, in another embodiment the case 100, 500, 800 is fabricated from a more flexible plastic or elastomeric material, or has integral flex points for engaging a radial surface. The case 100, 500, 800 can be made from stainless steel, aluminum, or other materials know in the art.

In embodiments, the soap travel case 100, 500, 800 comprises a low-density material that will float in water. In such embodiments, the density will be less than 1 g/cm$^3$.

In the arrangement shown in the figures, the soap travel case 100, 500, 800 comprises a rectangular profile. It is understood that the shape of the soap travel case 100, 500, 800 is not restricted to the pictured embodiments. In another embodiment the case 100, 500, 800 can have a more oval shape, or can have a diamond shape, or can be shaped as a star. In certain embodiments, the case can comprise an aesthetic shape that is pleasing to a child, such as a frog, a cow, a duck, a whale, a dinosaur, or a popular children's character. The case 100, 500, 800 is not limited to any particular shape so long as it has enough surface area to adequately receive and contain a bar of soap attached to a support. The soap travel case can be customized with specific logos, names, or colors.

In certain embodiments wherein the lid is hingedly attached to the base, the soap travel case is configured such that the base and lid are collinear with one another, i.e. lying flat, when the lid is completely open.

It is understood that the invention is not limited to any particular dimension unless expressly stated in the claims.

The soap travel case 100, 500, 800 soap support 220, and soap 201 can be sold commercially as an integral unit. In such embodiments, the soap support 220 be pre-implanted to the soap 201 and is packaged within the travel case 100, 500, 800 for retail purchase.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art. Those skilled in the art will recognize, or be able to ascertain, using no more than routine experimentation, numerous equivalents to the specific substances and procedures described herein.

What is claimed is:

1. An apparatus for storing a bar of soap to extend a life of the bar of soap by reducing the formation of soap goo, comprising:

a soap support, the soap support having a top side, a bottom side, and a sidewall extending between the top and bottom sides, the top side configured to attach the soap support to a bar of soap, the bottom side having an engagement contour, the sidewall enclosing an opening extending between the top and bottom sides, the opening promoting drying of a bar of soap, the side wall having at least one locking notch configured to receive a locking clip of a case portion, a case portion, the case portion comprising a base portion and a lid portion, the lid portion configured to selectively close the base portion for storage of a bar of soap, the base portion having a floor, the floor having a soap support receiving portion thereon, the soap support receiving portion having a seating contour for receiving the engagement contour of the soap support in a fixed and selectively lockable orientation relative to the base portion, a locking clip positioned and configured to selectively slide into the at least one locking notch when the seat support is seated in the seating contour to thereby selectively lock the soap support to the base portion, whereby a bar of soap attached to the soap support is elevated above the floor of the base to promote drying of the bar of soap, reduce formation of soap goo, and prolong the life of the bar of soap.

2. The apparatus of claim 1, wherein the at least one locking notch comprises a pair of locking notches, the pair of locking notches disposed on opposite sides of the soap support to facilitate locking of the soap support to the base.

3. The apparatus of claim 1, wherein when the soap support is locked on the base, a bar of soap attached to the soap support does not touch the case portion.

4. The apparatus of claim 1, wherein the soap support has an oval configuration having opposing short sides.

5. The apparatus of claim 4, wherein the at least one locking notch comprises a pair of locking notches, the pair of locking notches disposed on opposite sides of the soap support to facilitate locking of the soap support to the base.

6. The apparatus of claim 5, wherein the pair of locking notches are on the short sides.

7. The apparatus of claim 1, wherein the soap support has a circular configuration.

8. The apparatus of claim 4, wherein the at least one locking notch comprises a pair of locking notches, the pair of locking notches disposed on opposite sides of the soap support to facilitate locking of the soap support to the base.

9. The apparatus of claim 1, wherein the lid further comprises a means for inserting the locking clip into the locking notch of the soap support when the lid is in a closed position and removing the locking clip from the locking notch when the lid is in an open position.

10. The apparatus of claim 1, wherein the case further comprises a locking mechanism, the locking mechanism configured to permit a user to manually insert the locking clip into the locking notch of the soap support and to manually remove the locking clip from the soap support.

11. The apparatus of claim 1, wherein the locking notch is formed in the side wall.

12. The apparatus of claim 11, wherein the locking notch extends through the sidewall into the opening.

13. The apparatus of 1, wherein the opening of the soap support occupies a larger area than a top side of the sidewall to thereby enhance drying of a bar of soap on the soap support.

14. The apparatus of claim 1, wherein the soap support is configured such that when the top of the soap support is attached to a bar of soap, the bar of soap can be used to take a shower or bath without removing the bar of soap from the soap support.

* * * * *